US005716192A

United States Patent [19]

Phillips et al.

[11] Patent Number: 5,716,192

[45] Date of Patent: Feb. 10, 1998

[54] COOLING DUCT TURN GEOMETRY FOR BOWED AIRFOIL

[75] Inventors: James S. Phillips, Jupiter, Fla.; Brian P. Arness, Simpsonville, S.C.

[73] Assignee: United Technologies Corporation, Hartford, Conn.

[21] Appl. No.: 713,321

[22] Filed: Sep. 13, 1996

[51] Int. Cl.[6] ..... F01D 5/18; F01D 9/06

[52] U.S. Cl. ..... 415/115; 415/192; 416/96 R; 416/97 R; 416/238

[58] Field of Search ..... 415/115, 116, 415/191, 192, 193, 208.1, 208.2, 209.1, 210.1, 211.2, 915; 416/96 R, 96 A, 97 R, 97 A, 223 A, 238, 243, 242; 29/889.72, 889.721, 889.722

[56] References Cited

U.S. PATENT DOCUMENTS 4,257,737 3/1981 Andress et al. ..... 415/115
5,393,198 2/1995 Noda et al. ..... 415/115
5,525,038 6/1996 Sharma et al. ..... 416/238

FOREIGN PATENT DOCUMENTS 2199379 7/1988 United Kingdom ..... 416/223 A

*Primary Examiner*—Christopher Verdier
*Attorney, Agent, or Firm*—Richard D. Getz

[57] ABSTRACT

A bowed airfoil is provided which includes a plurality of passages disposed between a pressure side wall and a suction side wall. The pressure and suction side walls extend widthwise between a leading edge and a trailing edge, and spanwise between inner and outer platforms. Passages extend spanwise between the inner and outer platforms. Ribs, each having a rib end, separate adjacent passages. Passage turns, each having an end wall, connect the passages. The end wall of each passage turn acutely converges with one of the side walls, and a first fillet extends between the acutely converging side wall and end wall. According to one embodiment, each rib end acutely converges with the other of the side walls, and a second fillet extends between the acutely converging side wall and rib end.

14 Claims, 2 Drawing Sheets

FIG.1
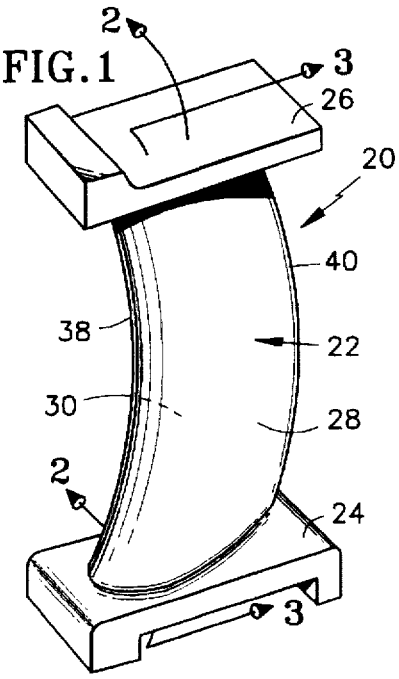
FIG.2
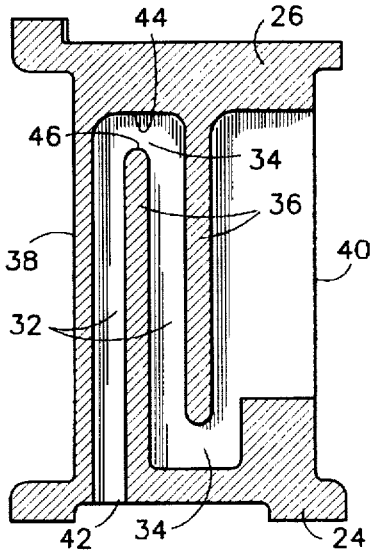
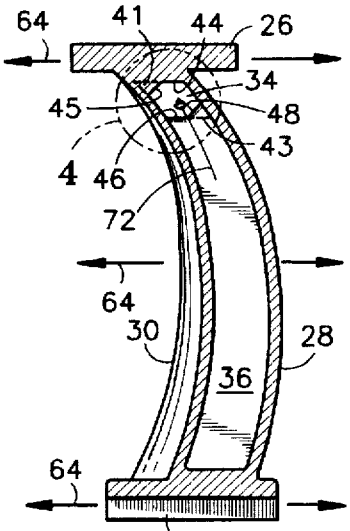
FIG.3
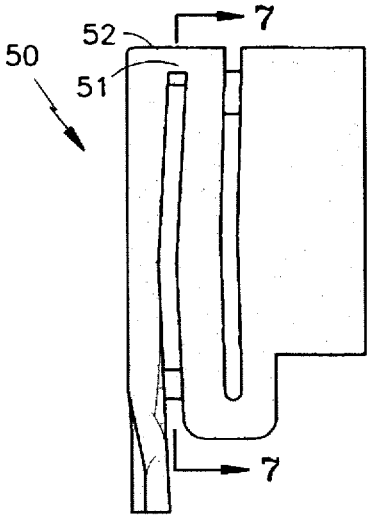
FIG.6
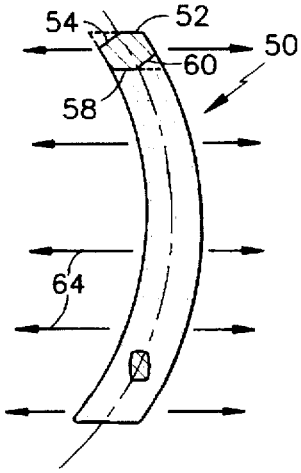
FIG.7
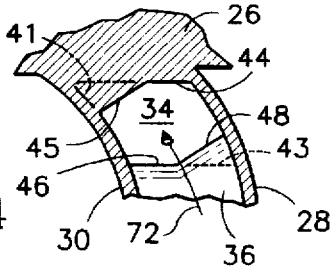
FIG.4
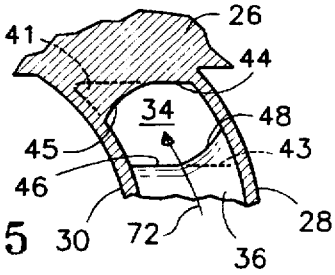
FIG.5

COOLING DUCT TURN GEOMETRY FOR BOWED AIRFOIL

The invention was made under a U.S. Government contract and the Government has rights herein.

BACKGROUND OF THE INVENTION

1. Technical Field

This invention relates to hollow airfoils in general, and to geometries of the internal cooling ducts within airfoils in particular.

2. Background Information

Internal cooling is a must in most gas turbine airfoils. Cooling is generally accomplished by passing cooling air through a serpentine of passages disposed within the airfoil. The internal passages, which extend spanwise within the airfoil, are connected to one another by 180° passage turns or widthwise extending passages, or by both. Typically, the internal passages are created by casting with a solid ceramic core which is later removed. The ceramic core is formed with a split die having a pressure side panel and a suction side panel. "Pressure side" and "suction side" are terms of art used to describe sides of the airfoil facing toward and away from gas flow passing through the engine, respectively. After the core has solidified, the die halves are separated along "pull lines" to release the solid core. A "pull line" refers to the imaginary line along which the die half is designed to be removed from the core.

The die method used to manufacture the core heavily influences the geometry of the internal passages. The surfaces of the core against which the rib ends and the end walls of the passage turns are formed have historically been designed to be substantially parallel to the pull lines. The parallelism between the core surfaces and the die walls facilitates die removal. A disadvantage of this approach is that internal passage geometry designed to achieve parallelism sometimes produces internal passages with less than optimum flow characteristics, particularly for bowed airfoils.

What is needed, therefore, is an internal flow passage geometry for bowed airfoils with improved flow characteristics.

DISCLOSURE OF THE INVENTION

It is, therefore, an object of the present invention to provide an airfoil having internal cooling passages with optimum flow characteristics.

Another object of the present invention is to provide an airfoil having internal cooling passages that help uniformly cool the airfoil.

Another object of the present invention is to provide an airfoil with improved internal cooling passages that can be readily manufactured.

Another object of the present invention is to provide a core for a bowed hollow airfoil that produces cooling passages with optimum flow characteristics, and one that can be readily manufactured.

According to the present invention, a bowed airfoil is provided which includes a plurality of passages disposed between a pressure side wall and a suction side wall. The pressure and suction side walls extend widthwise between a leading edge and a trailing edge, and spanwise between inner and outer platforms. Passages extend spanwise between the inner and outer platforms. Ribs, each having a rib end, separate adjacent passages. Passage turns, each having an end wall, connect the passages. The end wall of each passage turn acutely converges with one of the side walls, and a first fillet extends between the acutely converging side wall and end wall.

According to one embodiment of the present invention, each rib end acutely converges with the other of the side walls, and a second fillet extends between the acutely converging side wall and rib end.

An advantage of the present invention is that stagnant flow areas within the passage turns of an arcuate span airfoil are eliminated. Providing fillets in the acute angled corners otherwise formed between the side walls and the passage turn end wall and/or the rib end, eliminates the sharp corners created when the end walls and rib ends are parallel with the pull lines of the core die.

A further advantage of the present invention is that the separation of the die halves from the core is facilitated. Under the prior art method wherein the rib ends and the end walls of the core are substantially parallel to the pull lines, it is necessary to include a slight relief angle ($\leqq 3°$) to avoid the core die from dragging along the core during separation. Dragging the core die across the abrasive surface of the ceramic core abrades the surface of core die. The present invention, on the other hand, opens the angle between a portion of the rib end and passage turn end wall and thereby facilitates separation. A person of skill in the art will recognize that core dies are very costly and it is a distinct advantage to minimize die wear.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic perspective view of a vane singlet having an arcuate spanwise profile.

FIG. 2 is a diagrammatic view of the vane shown in FIG. 1, sectioned along lines 2—2.

FIG. 3 is a diagrammatic view of the vane shown in FIG. 1, sectioned along lines 3—3.

FIG. 4 is an enlarged view of a section of FIG. 3.

FIG. 5 is an enlarged view of a passage turn, similar to that shown in FIG. 4, showing fillets with an arcuate profile.

FIG. 6 is a diagrammatic view of a casting core for a hollow vane having an arcuate spanwise profile.

FIG. 7 is a diagrammatic view of the core shown in FIG. 6, sectioned along lines 7—7.

BEST MODE FOR CARRYING OUT THE INVENTION

Figure 8:
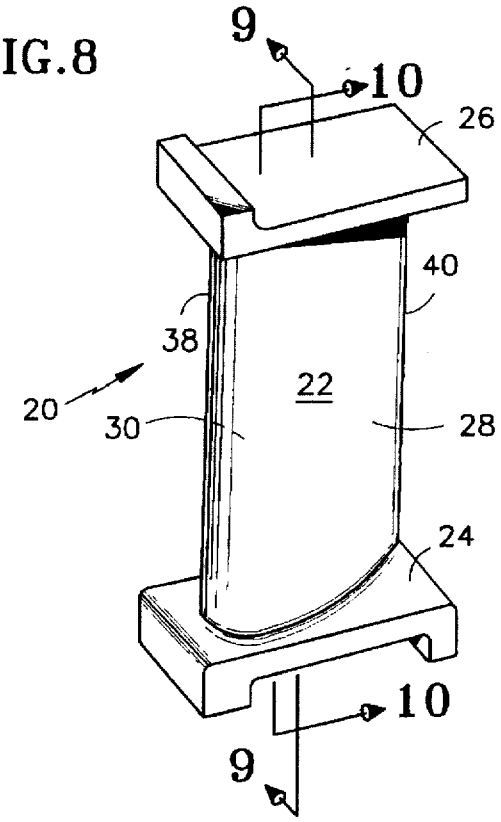
FIG. 8 is a diagrammatic perspective view of a vane singlet having a straight spanwise profile.

Referring to FIGS. 1-4, a stator assembly (not shown) comprises a plurality of vane segments 20 which collectively form an annular structure. Each vane segment 20 includes an airfoil 22, an inner platform 24 and an outer platform 26. The inner 24 and outer 26 platforms collectively provide the radial gas path boundaries through the stator assembly. Each airfoil 22 includes a pressure side wall 28, a suction side wall 30, and a plurality of passages 32, at least one passage turn 34, and ribs 36 disposed within the airfoil 22 between the pressure 28 and suction 30 side walls. The pressure 28 and suction 30 side walls extend widthwise between a leading edge 38 and a trailing edge 40, and spanwise between the inner 24 and outer 26 platforms. The distance between the pressure 28 and suction 30 side walls reflects the thickness of the airfoil 22. The pressure 28 and suction side 30 walls are arcuate or "bowed" in the spanwise direction.

The pressure 28 and suction 30 side walls and the ribs 36 provide the walls for the passages 32. In some embodiments, the leading edge 38 and/or trailing edge 40 may also provide a wall for a passage 32. All of the passages 32 extend spanwise between the inner 24 and outer 26 platforms and are, therefore, bowed along the same arcuate path as the pressure 28 and suction 30 side walls. The passage turns 34 connect adjacent passages 32 in a serpentine manner across the width of the airfoil 22, from leading edge 38 to trailing edge 40. The passage 32 adjacent the leading edge 38 typically includes an inlet 42 for receiving cooling air and the passage 32 adjacent the trailing edge 40 typically includes ports (not shown) for releasing cooling air into the gas path. Each passage turn 34 includes an end wall 44 extending widthwise between adjacent passages 32. A first acute angled corner 41 is formed between one of the side walls 28,30 and the end wall 44 due to the arcuate spanwise profile of the airfoil 22. As shown in FIG. 4, the side wall 30 and end wall 44 forming the first acute corner 41 may also be described as "acutely converging" toward one another. A first fillet 45 is disposed in the first acute angled corner 41. As shown in FIG. 4, the first fillet 45 may also be described as extending between the acutely converging side wall 30 and end wall 44. Each rib 36 includes an end surface 46, which is also referred to as the "rib end", disposed at a passage turn 34. A second acute angled corner 43 is formed between one of the side walls 28,30 and the rib end 46 due to the arcuate spanwise profile of the airfoil 22. As shown in FIG. 4, the side wall 28 and rib end 46 forming the second acute corner 43 may also be described as "acutely converging" toward one another. A second fillet 48 is disposed in the corner 43. As shown in FIG. 4, the second fillet 48 may also be described as extending between the acutely converging side wall 28 and the rib end 46. In the preferred embodiment, the exposed edge of the first and second fillets 45,48 is substantially perpendicular to the side walls 28,30.

Referring to FIGS. 6 and 7, each airfoil 22 is formed by investment casting using a ceramic core 50 representing the passages 32 within the airfoil 22. The geometry of the core 50 reflects the passage 32 voids that are found within the hollow airfoil 22. FIG. 6 shows a width-span plane view of a core 50, illustrating the serpentine nature of the passages 32. FIG. 7 shows a thickness-span plane view of the core 50 shown in FIG. 6, sectioned through a portion 51 of the core 50 that will form a passage turn 34, to illustrate the geometry of the passage turn 34. The surface 52 of core 50 against which the end wall 44 of the passage turn 34 will be formed, includes a surface 54 against which the first fillet 45 will be formed. Similarly, the surface 58 of core 50 against which the rib end 46 will be formed, includes a surface 60 against which the second fillet 48 will be formed.

Figure 9:
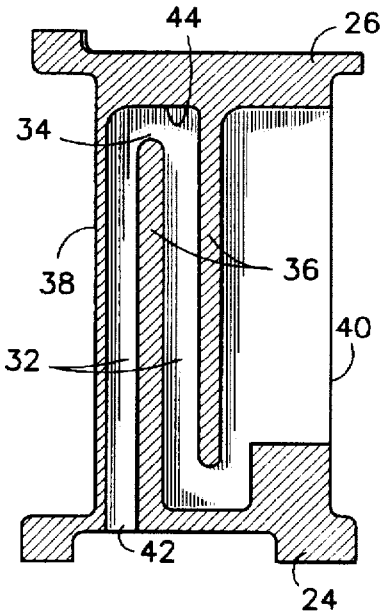
FIG. 9 is a diagrammatic view of the vane shown in FIG. 8, sectioned along lines 8—8.
Figure 10:
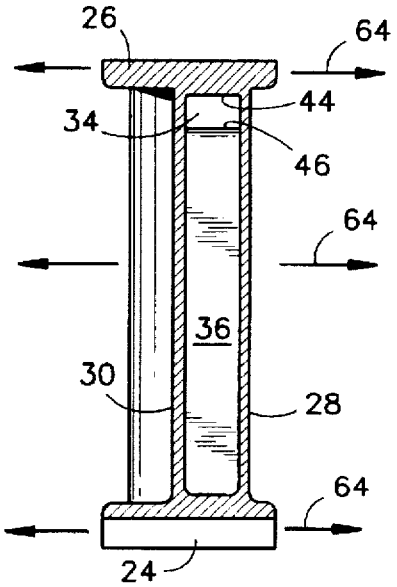
FIG. 10 is a diagrammatic view of the vane shown in FIG. 8, sectioned along lines 9—9.

To better understand the present invention, compare the end wall 44 of a passage turn 34 and a rib end 46 in an unbowed airfoil 22 (FIGS. 8–10) with that of a highly bowed airfoil 22 (FIGS. 1–3). In the unbowed airfoil 22, the spanwise extending passages 32 are essentially in a single plane and that plane is perpendicular to the pull lines 64. The end wall 44 and the rib end 46 in the unbowed airfoil 22 are also perpendicular to the plane, because the end wall 44 and rib end 46 are parallel to the pull lines 64. As a result, 90° angles are formed between the end wall 44 and the side walls 28,30, and between the rib end 46 and the side walls 28,30.

In a bowed airfoil 22, on the other hand, a rib end 46 and an end wall 44 maintained parallel to the pull lines 64 will be skewed relative to the side walls 28,30 of the passage 32 because the passage 32 follows an arcuate path (i.e., "a bow"). The skewed relationship between the side walls 28,30 and the end walls 44, and between the side walls 28,30 and the rib ends 46, forms acute angled comers 41,43 in the passage turns 34. The acute angles 41,43 foster undesirable flow anomalies within the comers which diminish circulation in the comers, and diminished circulation causes less than optimum cooling. The phantom lines shown in FIGS. 3–5 show the aforementioned acute angled comers 41,43.

The present invention vane segment 20 and core 50 eliminate problematic acute angled comers in passage turns 34, and therefore the consequent "hot spots", by providing fillets 45,48 within the acute comers 41,43. In the preferred embodiment, the first 45 and second 48 fillets are substantially perpendicular to the pressure 28 and suction 30 side walls; i.e., substantially perpendicular to the direction of flow 72 through the passage 32. In alternative embodiments, the fillets may have an arcuate profile relative to the side walls, as is shown in FIG. 5.

Although this invention has been shown and described with respect to the detailed embodiments thereof, it will be understood by those skilled in the art that various changes in form and detail thereof may be made without departing from the spirit and the scope of the invention.

We claim:

1. An airfoil, comprising:

a pressure wall side and a suction side wall, extending widthwise between a leading edge and a trailing edge, and spanwise between an inner radical surface and outer radial surface, and wherein said side walls are bowed spanwise;

a plurality of passages, extending spanwise between said inner and outer radial surfaces, disposed between said pressure and suction side walls;

at least one passage turn, connecting said passages, said at least one passage turn including an end wall;

a rib, separating said passages, having a rib end;

wherein said end wall and one of said side walls acutely converge; and a first fillet, extending between said acutely converging side wall and end wall.

2. An airfoil according to claim 1, wherein said first fillet is substantially perpendicular to said one of said side walls.

3. An airfoil according to claim 1, wherein said first fillet is arcuate.

4. An airfoil according to claim 1, further comprising:

a second fillet;

wherein said rib end acutely converges with the other of said side walls, and said second fillet extends between said acutely converging side wall and rib end.

5. An airfoil according to claim 4, wherein said second fillet is substantially perpendicular to said other of said side walls.

6. An airfoil according to claim 4, wherein said second fillet is arcuate.

7. A stator vane, comprising:

a pressure wall side and a suction side wall, extending widthwise between a leading edge and a trailing edge, and spanwise between an inner platform and an outer platform, and wherein said side walls are bowed spanwise;

a plurality of passages, extending spanwise between said inner and outer platforms, disposed between said pressure and suction side walls;

at least one passage turn, connecting said passages, said at least one passage turn including an end wall;

a rib, separating said passages, having a rib end;

wherein said end wall and one of said side walls arcuately converge; and a first fillet, extending between said acutely converging side wall and end wall.

8. A stator vane according to claim 7, wherein said first fillet is substantially perpendicular to said one of said side walls.

9. A stator vane according to claim 7, wherein said first fillet is arcuate.

10. A stator vane according to claim 7, further comprising:

a second fillet;

wherein said rib end and the other of said side walls acutely converge, and said second fillet extends between said acutely converging side wall and rib end.

11. A stator vane according to claim 10, wherein said second fillet is substantially perpendicular to said other of said side walls.

12. A stator vane according to claim 10, wherein said second fillet is arcuate.

13. A stator vane according to claim 10, wherein said first fillet is substantially perpendicular to said one of said side walls.

14. A stator vane according to claim 10, wherein said first fillet is arcuate.

* * * * *